US009862105B2

(12) United States Patent
Liang

(10) Patent No.: US 9,862,105 B2
(45) Date of Patent: Jan. 9, 2018

(54) FOLDING KNIFE WITH SAFETY DEVICE

(71) Applicant: GUANGXI RUIKE OUTDOOR TOOLS MANUFACTURING CO., LTD., Yulin, Guangxi (CN)

(72) Inventor: Gang Liang, Guangxi (CN)

(73) Assignee: GUANGXI RUIKE OUTDOOR TOOLS MANUFACTURING CO., LTD., Yulin (CN)

( * ) Notice: Subject to any disclaimer, the term of this patent is extended or adjusted under 35 U.S.C. 154(b) by 70 days.

(21) Appl. No.: 15/166,706

(22) Filed: May 27, 2016

(65) Prior Publication Data

US 2017/0182670 A1 Jun. 29, 2017

(30) Foreign Application Priority Data

Dec. 25, 2015 (CN) ..... 2015 1 0987983

(51) Int. Cl.
*B26B 1/04* (2006.01)

(52) U.S. Cl.
CPC ..... *B26B 1/048* (2013.01)

(58) Field of Classification Search
CPC ..... B26B 1/048
USPC ..... 30/157, 160, 161
See application file for complete search history.

(56) References Cited

U.S. PATENT DOCUMENTS 1,357,398 A * 11/1920 Haywood ..... B26B 1/046 30/161
1,864,011 A * 6/1932 Brown ..... B26B 1/04 24/265 WS
4,354,313 A * 10/1982 Naifeh ..... B26B 1/048 30/161
4,974,323 A * 12/1990 Cassady ..... B26B 1/048 30/155
5,131,149 A * 7/1992 Thompson ..... B26B 1/048 30/161
5,325,588 A * 7/1994 Rogers ..... B25G 1/06 30/155
5,615,484 A * 4/1997 Pittman ..... B26B 1/048 30/155
5,699,615 A * 12/1997 Chen ..... B26B 1/044 30/160
5,964,036 A * 10/1999 Centofante ..... B26B 1/046 30/155
6,122,829 A * 9/2000 McHenry ..... B26B 1/048 30/160
6,276,063 B1 * 8/2001 Chen ..... B26B 1/046 30/155
6,360,443 B1 * 3/2002 Remus ..... B26B 1/046 30/158

(Continued)

*Primary Examiner* — Sean Michalski

(57) ABSTRACT

Disclosed is a folding knife with safety device, which includes a main knife, a revolving shaft, a first liner plate, a first rivet, a switch lock sheet, a first handle part, a second handle part, a second liner plate and a spacer sleeve. The first liner plate is provided with a resilient lock sheet, an elongated slot, a stopper portion, a first rivet, a second rivet and a third rivet; the switch lock sheet is provided with a first rivet slot, a skidproof rack, a second rivet slot, a labor-saving slot, a locking contact, and a buckle; and the first handle part is provided with an axle hole, a holding slot, a holding hole and a screw hole. The present invention has advantages of simple structure, easy of use and stable performance.

9 Claims, 3 Drawing Sheets

(56) References Cited

U.S. PATENT DOCUMENTS

| | | | | |
|---|---|---|---|---|
| 7,059,053 | B2 * | 6/2006 | Sakai | B26B 1/048 30/160 |
| 7,080,457 | B2 * | 7/2006 | Sullivan | B26B 1/046 30/160 |
| 7,107,685 | B1 * | 9/2006 | Anderson | B26B 1/044 30/158 |
| 7,325,312 | B1 * | 2/2008 | Janich | B26B 1/048 30/153 |
| 7,395,599 | B2 * | 7/2008 | Onion | B26B 1/02 30/158 |
| 7,469,476 | B2 * | 12/2008 | Demko | B26B 1/042 30/160 |
| 7,603,778 | B1 * | 10/2009 | Lerch | B26B 1/044 30/160 |
| 7,676,931 | B2 * | 3/2010 | Knight | B26B 1/02 30/158 |
| 7,979,990 | B2 * | 7/2011 | Hawk | B26B 1/048 30/155 |
| 8,020,302 | B2 * | 9/2011 | Kao | B26B 1/02 30/155 |
| 8,161,653 | B2 * | 4/2012 | Nenadic | B26B 1/04 30/155 |
| 8,863,393 | B2 * | 10/2014 | Chen | B26B 1/044 30/160 |
| 9,346,176 | B2 * | 5/2016 | Collins | B26B 1/048 |
| 9,427,878 | B2 * | 8/2016 | Hernandez | B26B 1/042 |
| 2004/0078981 | A1 * | 4/2004 | Cheng | B26B 1/044 30/161 |

* cited by examiner

FOLDING KNIFE WITH SAFETY DEVICE

CROSS-REFERENCE TO RELATED APPLICATIONS

This present invention claims the benefit of Chinese Patent Application No. 201510987983.7, filed on Dec. 25, 2015; the contents of which are hereby incorporated by reference.

FIELD OF THE INVENTION

The present invention relates to folding knifes and, in particular, it concerns a folding knife with safety device.

BACKGROUND OF THE INVENTION

In the existing safety device of folding knife, specifically liner lock folding knife, the switch of the safety device is generally provided with independent spring component, and due to such a structure, it is not convenient to be installed and it is easy to cause low stability because of the spring. Additionally, in most cases, the switch of the safety device is provided at a middle position of outer side surface of the handle, and due to such a structure, it is not convenient to operate and it affects the appearance of the handle.

SUMMARY OF THE INVENTION

An object of the present invention is to provide a folding knife with safety device, which has simple structure, easy operation and stable performance, so as to overcome the defects of the prior art.

To achieve the above object, there is provided a technical solution as follows:

A folding knife with safety device includes a main knife, a stopper pin, a revolving shaft, a first liner plate, a first rivet, a switch lock sheet, a first handle part, a first screw, a second handle part, a second screw, a second liner plate and a spacer sleeve. The first liner plate is provided with a resilient lock sheet, an elongated slot, a second rivet hole, a stopper portion, a first rivet hole and a third rivet hole; a first rivet, a second rivet and a third rivet are mounted on the second rivet hole, first rivet hole and third rivet hole, respectively; the switch lock sheet is provided with a first rivet slot, a skidproof rack, a second rivet slot, a labor-saving slot, a locking contact, and a buckle; and the first handle part is provided with an axle hole, a holding slot, a holding hole and a screw hole.

Preferably, the folding knife with safety device according to claim 1, wherein the stopper portion of the first liner plate is provided on the resilient lock sheet and above the elongated slot.

Preferably, the folding knife with safety device according to claim 1, wherein the switch lock sheet is provided in the holding slot which is formed on inner side of the first handle part; the buckle of the switch lock sheet is bending and extending into the elongated slot of the first liner plate; the first rivet slot and the second rivet slot formed on the switch lock sheet are mounted on the first rivet and the second rivet, respectively; a side surface of the switch lock sheet tightly contacts with a side surface of the first liner plate and the locking contact resiliently contacts with the third rivet.

Preferably, the folding knife with safety device according to claim 1, wherein the revolving shaft passes through the first liner plate, the main knife and the second liner plate successively; two ends of the spacer sleeve pass through a spacer sleeve hole formed on the first liner plate and a spacer sleeve hole formed on the second liner plate, respectively and then the spacer sleeve is fixed between the first liner plate and the second liner plate by the second screw; the first handle part and the second handle part are fixed to a side surface of the first liner plate and a side surface of the second liner plate, respectively, by the first screw.

Preferably, the folding knife with safety device according to claim 4, wherein when the safety device is in a locked state, the buckle of the switch lock sheet contacts with the stopper portion of the first liner plate so that the main knife is unable to be unlocked; and when the safety device is in an unlocked state, the buckle of the switch lock sheet moves away from a movement area of the stopper portion of the first liner plate so that the resilient lock sheet of the first liner plate is pushed to make the main knife be unlocked.

Preferably, the folding knife with safety device according to claim 1, wherein when the safety device is in a locked or unlocked state, the switch lock sheet is at starting point or end point of a sliding trace, the locking contact is at a side of a center of the third rivet so that an acting force suffered by the locking contact is smallest; and during the safety device being locked or unlocked, when the switch lock sheet moves to a middle point of the sliding trace, the locking contact is right above a center of the third rivet so that the acting force suffered by the locking contact is largest.

Compared with the prior art, the present invention has some beneficial effects as follows:

1. In the present invention, a switch lock sheet is included in the safety device to achieve functions of switch and spring, thus it is easy to be installed and it can increase the stability and life time;

2. In the present invention, the switch of the safety device is provided in inner side of the handle, thus it is convenient to operate and it does not affect the appearance of the handle.

REFERENCE NUMBERS OF THE DRAWINGS

Figure 1:
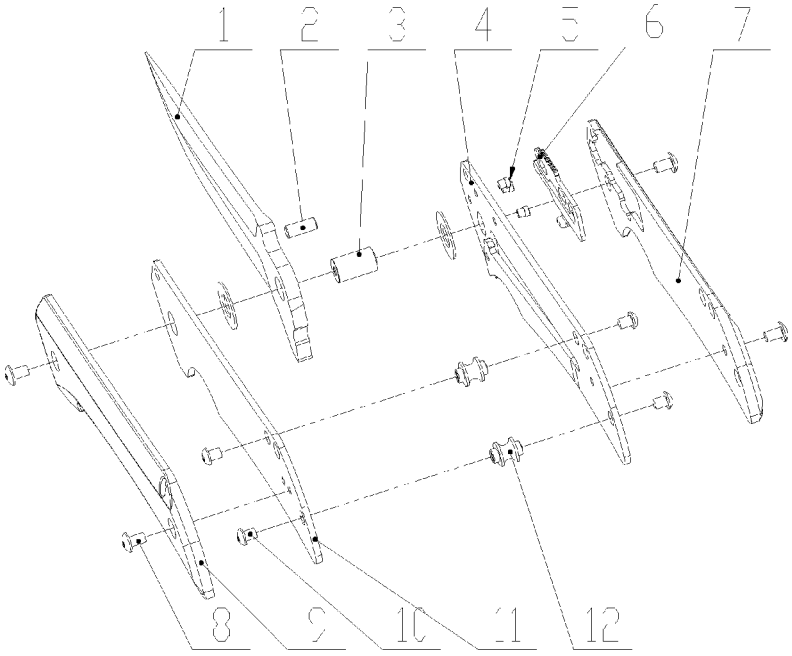
FIG. 1 is an exploded view illustrating a folding knife with safety device according to an embodiment of the present invention.

Main knife 1; stopper pin 2; revolving shaft 3; first liner plate 4; first rivet 5; switch lock sheet 6; first handle part 7; first screw 8; second handle part 9; second screw 10; second liner plate 11; spacer sleeve 12; resilient lock sheet 13; elongated slot 14; second rivet hole 15; stopper portion 16; first rivet hole 17; third rivet hole 18; first rivet slot 19; skidproof rack 20; second rivet slot 21; labor-saving slot 22;

locking contact 23; buckle 24; axle hole 25; holding slot 26; holding hole 27; screw hole 28; second rivet 29; third rivet 30.

DETAILED DESCRIPTION OF ILLUSTRATED EMBODIMENTS

The present invention will become more clearly by means of the following description combining the accompanying drawings, which are used to illustrate embodiments of the present invention.

Figure 2:
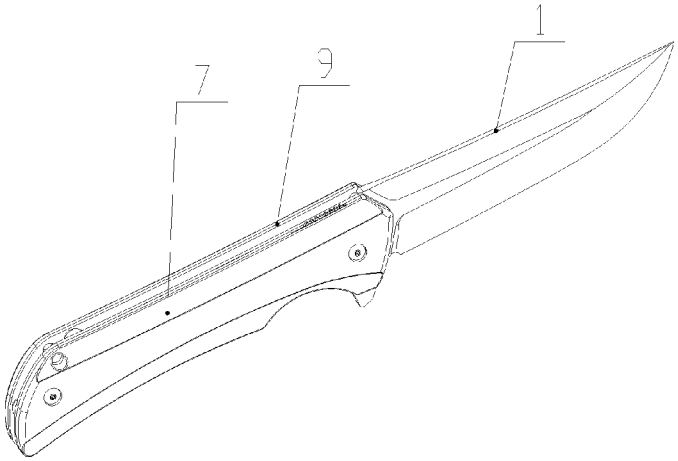
FIG. 2 is a perspective view illustrating the folding knife with safety device according to an embodiment of the present invention.
Figure 3:
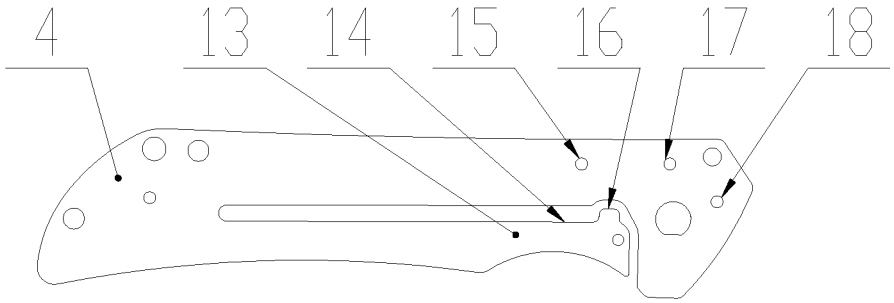
FIG. 3 is a rear view illustrating a first liner plate of the folding knife with safety device according to an embodiment of the present invention.
Figure 4:
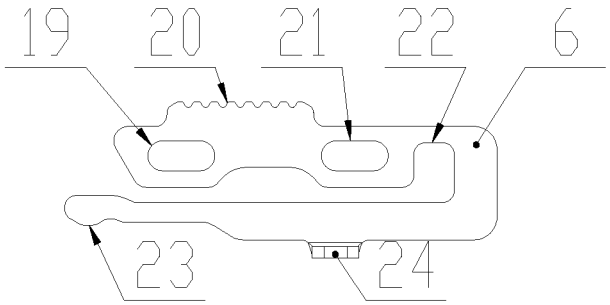
FIG. 4 is a front view illustrating a switch lock sheet of the folding knife with safety device according to an embodiment of the present invention.
Figure 5:
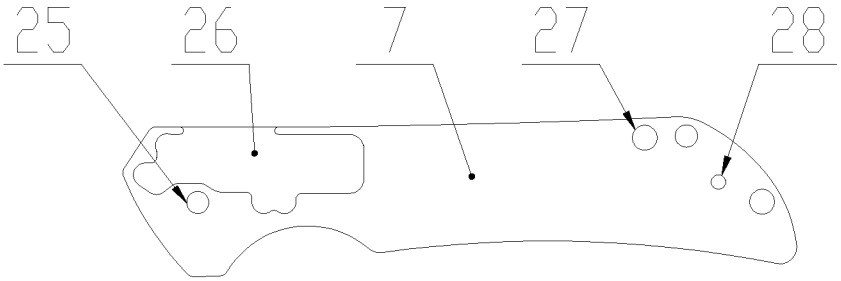
FIG. 5 is a rear view illustrating a first handle part of the folding knife with safety device according to an embodiment of the present invention.
Figure 6:
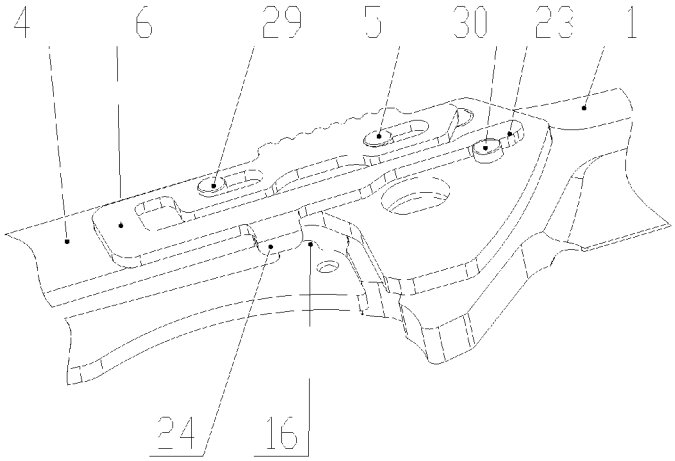
FIG. 6 is a partial perspective view illustrating the safety device being in a locked state.
Figure 7:
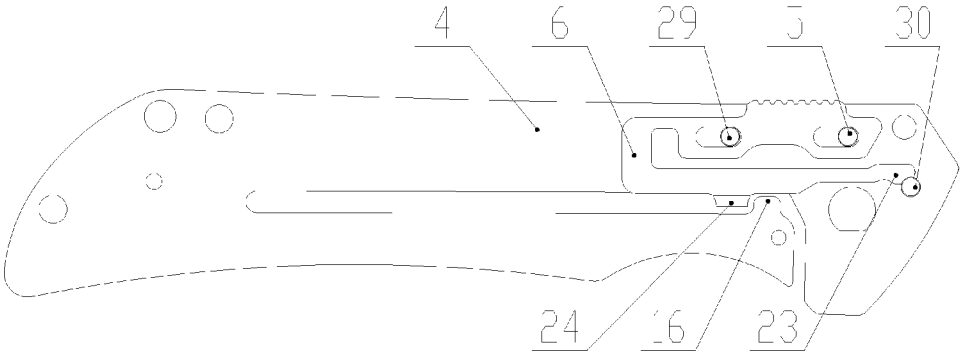
FIG. 7 is a partial perspective view illustrating the safety device being in an unlocked state.

As shown from FIG. 1 to FIG. 7, a folding knife with safety device includes main knife 1, revolving shaft 32, first liner plate 4, first rivet 5, switch lock sheet 6, first handle part 7, second handle part 9 and second liner plate 11. The first liner plate 4 has resilient lock sheet13, elongated slot 14, second rivet hole 15, stopper portion 16, first rivet hole 17 and third rivet hole 18. A first rivet 5, second rivet 29 and third rivet 30 are provided to be mounted on the second rivet hole 15, first rivet hole 17 and third rivet hole 18, respectively. The switch lock sheet 6 is provided with first rivet slot 19, skidproof rack 20, second rivet slot 21, labor-saving slot 22, locking contact 23 and buckle 24. The first handle part 7 is provided with axle hole 25, holding slot 26, holding hole 27 and screw hole 28.

The stopper portion 16 of the first liner plate 4 is provided on the resilient lock sheet 13 and above the elongated slot 14.

The switch lock sheet 6 is mounted in the holding slot 26 which is formed on inner side of the first handle part. The buckle 24 of the switch lock sheet 6 is bending and extending into the elongated slot 14 of the first liner plate 4. The switch lock sheet 6 has a labor-saving slot 22 formed thereon so that the locking contact 23 can produce deformation under the effect of external force, that is, the locking contact 23 is resilient thus there needs no spring. The first rivet slot 19 and the second rivet slot 21 formed on the switch lock sheet 6 are mounted on the first rivet 5 and the second rivet 29, respectively. A side surface of the switch lock sheet 6 tightly contacts with a side surface of the first liner plate 4 and the locking contact 23 resiliently contacts with the third rivet 30. When the main knife 1 is in a locked state, the switch stopper 6 can be pushed forward or backward.

The revolving shaft 3 passes through the first liner plate 4, the main knife 1 and the second liner plate 11 successively; two ends of the spacer sleeve 12 pass through a spacer sleeve hole formed on the first liner plate 4 and a spacer sleeve hole formed on the second liner plate 11, respectively, and then the spacer sleeve 12 is fixed between the first liner plate 4 and the second liner plate 11 by the second screw 10; the first handle part 7 and the second handle part 9 are fixed to a side surface of the first liner plate 4 and a side surface of the second liner plate 11, respectively, by the first screw 8.

When the safety device is in a locked state, the buckle 24 of the switch lock sheet 6 contacts with the stopper portion 16 of the first liner plate 4 so that the main knife 1 is unable to be unlocked; and when the safety device is in an unlocked state, the buckle 24 of the switch lock sheet 6 moves away from a movement area of the stopper portion 16 of the first liner plate 4 so that the resilient lock sheet 13 of the first liner plate 1 is pushed to make the main knife 1 be unlocked.

When the safety device is in a locked or unlocked state, the switch lock sheet 6 is at starting point or end point of a sliding trace, the locking contact 23 is at a side of center of the third rivet 30 so that an acting force suffered by the locking contact 23 is smallest; and during the safety device being locked or unlocked, when the switch lock sheet 6 moves to a middle point of the sliding trace, the locking contact 23 is right above the center of the third rivet 30 so that the acting force suffered by the locking contact 23 is largest.

The operating principle of the safety device of this embodiment will be described as follows:

Open the main knife 1 until the main knife 1 is locked by the resilient lock sheet 13; press the skidproof rack 20 provided on the switch lock sheet 6 and push the switch lock sheet 6 forward to make the buckle 24 of the switch lock sheet 6 contact with the stopper portion 16 of the first liner plate 4; at this time, the resilient lock sheet 13 provided on the first liner plate 4 cannot swing, thus the main knife 1 cannot be unlocked, that is, the safety device is in a locked state. Push the switch lock sheet 6 backward to make the buckle 24 of the switch lock sheet 6 move away from the movement area of the stopper portion 16 of the first liner plate 4, at this time, the resilient lock sheet 13 of the first liner plate 4 can be pushed to make the main knife be unlocked, that is, the safety device is in an unlocked state.

During the safety device being locked or unlocked, when the switch lock sheet 6 moves to a middle point of the sliding trace, the locking contact 23 is right above the center of the third rivet 30, thus the elastic resistance is largest.

When the switch lock sheet 6 is at starting point or end point of a sliding trace, that is, the safety device is in a locked or unlocked state, the locking contact 23 of the switch lock sheet 6 is at a side of the center of the third rivet 30, thus the elastic resistance is smallest, at this time, the switch lock sheet 6 remains in a stable state.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A folding knife with safety device, comprising a main knife, a stopper pin, a revolving shaft, a first liner plate, a first rivet, a switch lock sheet, a first handle part, a first screw, a second handle part, a second screw, a second liner plate and a spacer sleeve, wherein the first liner plate is provided with a resilient lock sheet, an elongated slot, a second rivet hole, a stopper portion, a first rivet hole and a third rivet hole; a first rivet, a second rivet and a third rivet are mounted on the second rivet hole, first rivet hole and third rivet hole, respectively; the switch lock sheet is provided with a first rivet slot, a skidproof rack, a second rivet slot, a labor-saving slot, a locking contact, and a buckle; and the first handle part is provided with an axle hole, a holding slot, a holding hole and a screw hole.

2. The folding knife with safety device according to claim 1, wherein the stopper portion of the first liner plate is provided on the resilient lock sheet and extending into the elongated slot.

3. The folding knife with safety device according to claim 1, wherein the switch lock sheet is provided in the holding slot which is formed on inner side of the first handle part; the buckle of the switch lock sheet is bending and extending into the elongated slot of the first liner plate; the first rivet slot and the second rivet slot formed on the switch lock sheet are mounted on the first rivet and the second rivet, respectively; a side surface of the switch lock sheet tightly contacts with a side surface of the first liner plate and the locking contact resiliently contacts with the third rivet.

4. The folding knife with safety device according to claim 1, wherein the revolving shaft passes through the first liner plate, the main knife and the second liner plate successively; two ends of the spacer sleeve pass through a spacer sleeve hole formed on the first liner plate and a spacer sleeve hole formed on the second liner plate, respectively and then the spacer sleeve is fixed between the first liner plate and the second liner plate by the second screw; the first handle part and the second handle part are fixed to a side surface of the first liner plate and a side surface of the second liner plate, respectively, by the first screw.

5. The folding knife with safety device according to claim 4, wherein when the safety device is in a locked state, the buckle of the switch lock sheet contacts with the stopper portion of the first liner plate so that the main knife is unable to be unlocked; and when the safety device is in an unlocked state, the buckle of the switch lock sheet moves away from a movement area of the stopper portion of the first liner plate so that the resilient lock sheet of the first liner plate is pushed to make the main knife be unlocked.

6. The folding knife with safety device according to claim 1, wherein when the safety device is in a locked or unlocked state, the switch lock sheet is at starting point or end point of a sliding trace, the locking contact is at a side of a center of the third rivet so that an acting force suffered by the locking contact is smallest; and during the safety device being locked or unlocked, when the switch lock sheet moves to a middle point of the sliding trace, the locking contact is right above a center of the third rivet so that the acting force suffered by the locking contact is largest.

7. A folding knife with safety device, comprising a first handle part, a first liner plate fixed to the first handle part, a second handle part, a second liner plate fixed to the second handle part, a main knife disposed between the first handle part and the second handle part and able to rotate relative to the first handle part and the second handle part, wherein the first liner plate is provided with a resilient lock sheet, an elongated slot, a stopper portion formed on the resilient lock sheet and extending into the elongated slot, a first rivet, a second rivet and a third rivet; the switch lock sheet is provided with a first rivet slot, a second rivet slot, a skidproof rack, a labor-saving slot, a locking contact and a buckle; and the first handle part is provided with a holding slot formed on an inner side thereof;

the buckle of the switch lock sheet is bending and extending into the elongated slot of the first liner plate; the first rivet slot and the second rivet slot formed on the switch lock sheet are mounted on the first rivet and the second rivet, respectively; a side surface of the switch lock sheet tightly contacts with a side surface of the first liner plate and the locking contact resiliently contacts with the third rivet; and the switch lock sheet is provided in the holding slot of the first handle part so that the switch lock sheet is sandwiched between the first liner plate and the first handle part;

when the safety device is in a locked state, the buckle of the switch lock sheet contacts with the stopper portion of the first liner plate so that the main knife is unable to be unlocked; and when the safety device is in an unlocked state, the buckle of the switch lock sheet moves away from a movement area of the stopper portion of the first liner plate so that the resilient lock sheet of the first liner plate is pushed to make the main knife be unlocked.

8. The folding knife with safety device according to claim 7, wherein further comprises a revolving shaft and a spacer sleeve; the revolving shaft passes through the first liner plate, the main knife and the second liner plate successively; two ends of the spacer sleeve pass through a spacer sleeve hole formed on the first liner plate and a spacer sleeve hole formed on the second liner plate, respectively and then the spacer sleeve is fixed between the first liner plate and the second liner plate by a second screw; the first handle part and the second handle part are fixed to a side surface of the first liner plate and a side surface of the second liner plate, respectively, by a first screw.

9. The folding knife with safety device according to claim 7, wherein when the safety device is in a locked or unlocked state, the switch lock sheet is at starting point or end point of a sliding trace, the locking contact is at a side of a center of the third rivet so that an acting force suffered by the locking contact is smallest; and during the safety device being locked or unlocked, when the switch lock sheet moves to a middle point of the sliding trace, the locking contact is right above a center of the third rivet so that the acting force suffered by the locking contact is largest.

* * * * *